United States Patent [19]

Berry

[11] 4,442,564

[45] Apr. 17, 1984

[54] GOLF BALL CLEANER

[76] Inventor: William J. Berry, 498 Franklin La., Elk Grove Village, Ill. 60007

[21] Appl. No.: 429,841

[22] Filed: Sep. 30, 1982

[51] Int. Cl.[3] ..... A63B 47/04

[52] U.S. Cl. ..... 15/21 A; 15/97 R

[58] Field of Search ..... 15/21 A, 104.92, 160, 15/97 R; 401/9, 10

[56] References Cited

U.S. PATENT DOCUMENTS

| | | | |
|---|---|---|---|
| 3,378,873 | 4/1968 | Strout | 15/104.92 |
| 3,740,784 | 6/1973 | Morrissey | 15/21 A |
| 3,981,039 | 9/1976 | Rumph | 15/21 A |

*Primary Examiner*—Timothy F. Simone

*Attorney, Agent, or Firm*—Wood, Dalton, Phillips, Mason & Rowe

[57] ABSTRACT

A portable golf ball cleaner having a container with relatively movable portions permitting a golf ball to be inserted into a ball cleaning space defined by inwardly projecting bristles thereof. A carrier is rotatably mounted to the container wall and includes bristles projecting to the ball receiving space to engage a ball supported on the fixed bristles therein. A manually operable handle is provided on the carrier for rotating the carrier to cause random rotation movement of the golf ball. A quantity of cleaning solution may be placed in the container for use in facilitating the cleaning of the ball by a relative movement between the ball and the bristles in the container.

15 Claims, 4 Drawing Figures

FIG. 1
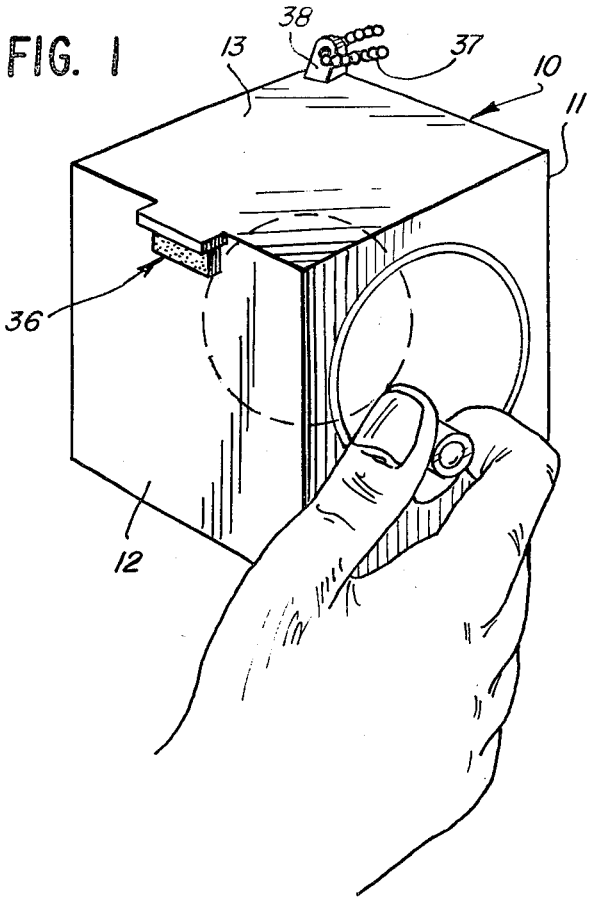
FIG. 2
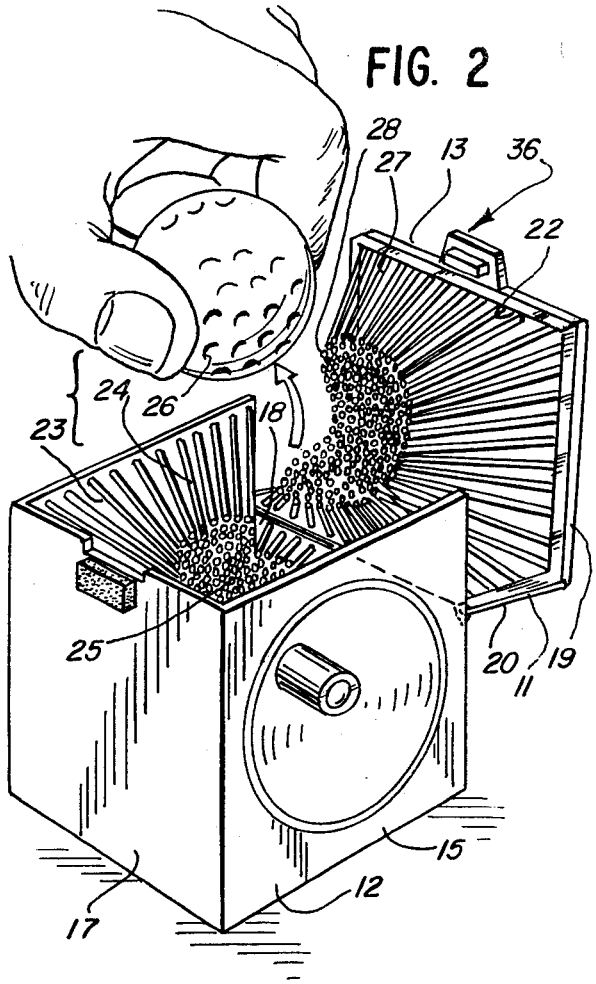
FIG. 3
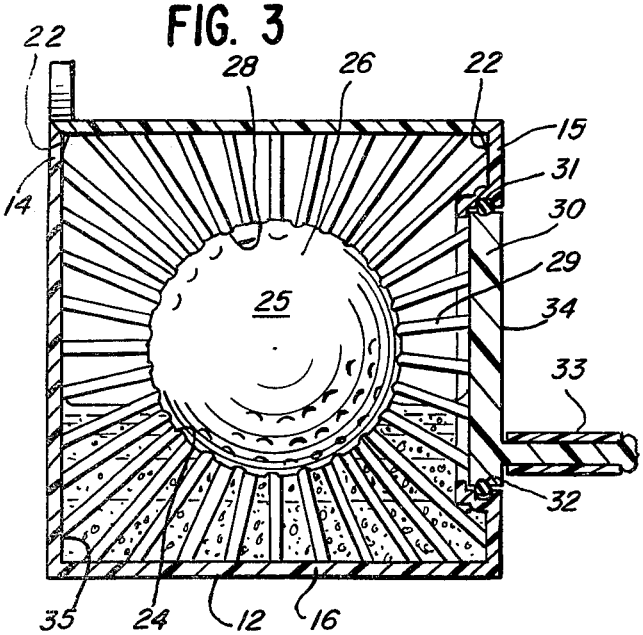
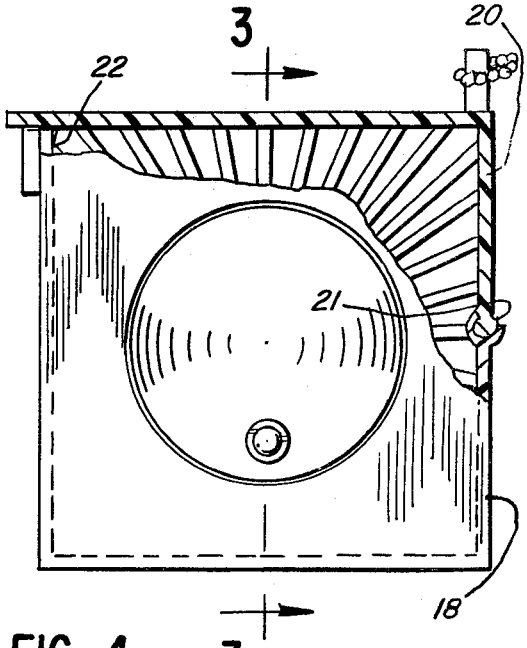
FIG. 4

GOLF BALL CLEANER

BACKGROUND OF THE INVENTION

1. Field of the Invention

This invention relates to golf ball cleaners and in particular to portable golf ball cleaners.

2. Description of the Background Art

A number of portable golf ball cleaners have been developed for use in cleaning the player's ball where the conventional grounds-mounted cleaners are not available. Such known portable cleaners have the serious disadvantage of leaking when disposed in other than an upright position.

One form of commercially available portable cleaner utilizes a cylindrical housing having a sponge rubber pillow portion at the upper end, with cleaning solution being flowable through the pillow to treat the surface of the ball which is rubbed thereagainst. Such a device has the serious disadvantage of permitting the fluid to leak out through the pillow whenever the device is inclined horizontally or upside down.

It is desirable that such portable golf ball cleaners be capable of being disposed in any position, such as in the player's golf bag or freely carried on a golf cart, or the like. Under such conditions, the known cleaners, permitting leaking of the cleaning fluid outwardly therefrom in such nonupright positions, are highly undesirable.

SUMMARY OF THE INVENTION

The present invention comprehends an improved portable golf ball cleaner which is leakproof while yet permitting facilitated cleaning of a golf ball rapidly and efficiently.

More specifically, the invention comprehends provision of such a portable golf ball cleaner including a container having a cleaning liquid receptacle portion and a movable cover portion cooperatively defining an internal, sealed ball cleaning space, fixed bristles projecting inwardly from the container portions to define an inner ball receiving space at the inner distal end thereof, a carrier rotatably, sealingly mounted to the container and having bristles projecting to the ball receiving space to engage a ball supported therein on the fixed bristles, and means for rotating the carrier to cause random rotative movement of a golf ball received in the ball receiving space for cleaning of the ball surface by the distal ends of the bristles, the sealed container portions preventing discharge of cleaning liquid from the container during a ball cleaning operation.

In the illustrated embodiment, the cover portion is hingedly secured to the liquid receptacle portion.

In the illustrated embodiment, latch means are provided for releasably locking the cover portion to the liquid receptacle portion in a closed, sealed arrangement of the receptacle.

More specifically in the illustrated embodiment, the latch means comprises magnetic latch means.

The invention comprehends the provision of flexible connecting means associated with the receptacle for attaching the golf ball cleaner to a support, such as a golf bag, or the like.

The fixed bristles define an exposed ball receiving space when the cover portion is moved to an open position facilitating ready insertion of the ball to be cleaned into the exposed ball receiving space.

In the illustrated embodiment, the bristles on the carrier comprise bristles having a stiffness greater than the stiffness of the fixed bristles.

In the illustrated embodiment, the rotating means comprises manually operable handle means.

In the illustrated embodiment, the container comprises a parallelepiped container.

Thus, the portable golf ball cleaner of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a portable golf ball cleaner embodying the invention as during use in cleaning a player's golf ball;

FIG. 2 is a perspective view illustrating the insertion of the golf ball into the golf ball cleaner;

FIG. 3 is a fragmentary vertical section taken substantially along the line 3—3 of FIG. 4; and FIG. 4 is a fragmentary side elevation with a portion broken away for illustrating in greater detail the hinged mounting of the cover portion of the container to the liquid receptacle portion thereof.

DESCRIPTION OF THE PREFERRED EMBODIMENT

In the illustrative embodiment of the invention as disclosed in the drawing, a portable golf ball cleaner generally designated 10 is shown to comprise a container 11 having a cleaning liquid receptacle portion 12 and a cover portion 13. In the illustrated embodiment, the container comprises a parallelepiped container, with the cleaning liquid receptacle portion 12 including sidewalls 14 and 15, bottom wall 16, front wall 17, and a partial rear wall 18.

Cover portion 13 is defined by a top wall 19 and a downturned rear wall 20. As shown in FIG. 4, rear wall 18 may be joined at its lower end to the upper end of rear wall 18 by an integral socket hinge 21. The peripheral inner surface of the cover portion is provided with an inturned feather seal flange 22, which, as seen in FIGS. 3 and 4, seals against the inner surface of the edge of the sidewalls of the container portion 12 when the cover is in the closed position.

Each of sidewalls 14 and 15, bottom wall 16 and front wall 17 of the liquid container portion 12 is provided with inwardly projecting fixed bristles 23 having their inner distal ends 24 terminating in a spherical configuration defining a ball receiving space 25 for receiving a golf ball 26, or the like.

Additional fixed bristles 27 are provided on the cover portion 13 also extending inwardly to have their distal ends 28 further define a portion of the spherical space 25 when the cover is in the closed disposition of FIG. 1.

As shown in FIG. 2, when the cover is in the open position, the ball receiving space 25 is exposed for freely receiving the golf ball 26. When the cover is moved to the closed position, as shown in FIG. 3, the bristle ends 24 and 28 engage the outer surface of the golf ball for use in effecting a cleaning thereof upon rotation of the golf ball in space 25.

Such rotation of the golf ball is effected herein by means of a plurality of bristles 29 carried on a rotatable carrier 30 sealingly rotatably mounted to the sidewall 15 of the liquid container portion by means of a slidable annular seal 31 received in a suitable groove 32 in the sidewall. Carrier 30 is rotated in annular seal 31 by means of a handle 33 so as to rotate the bristles 29 about the axis 34 of the carrier. Bristles 29 are preferably relatively stiff so as to effect a random rotation of golf ball 26 in the ball receiving space 25 so as to cause relative movement between the bristle ends and the ball to effect the desired cleaning action.

As shown in FIG. 3, the lower portion of the liquid container portion 12 may be filled with a suitable detergent solution 35 to assist in the ball cleaning operation.

The sealed closure of container 11 effectively precludes leaking of the detergent solution 35 outwardly from the container, notwithstanding the disposition of the container in any attitude. To secure the cover portion 13 in the sealed closed position, a suitable latch 36 is provided. In the illustrated embodiment, the latch comprises a magnetic latch for releasably securing the cover in the closed position of FIGS. 1, 3 and 4, while yet permitting ready movement of the cover portion to the open position of FIG. 2, when desired. As indicated above, the feather seal 22 and seal ring 31 effectively seal the relatively movable portions of the golf ball cleaner in the closed disposition so as to effectively preclude such undesirable leakage of the cleaning solution.

The invention further comprehends the provision of a flexible connecting element, such as chain 37, connected to the container by means of a lug 38 through which the connecting element is extended such as for use in supporting the golf ball cleaner on a golf bag, golf cart, etc.

In the illustrated embodiment, the bristles 29 have a stiffness somewhat greater than the fixed bristles 23 and 27 so as to efficiently cause random rotation of the golf ball in effecting the desired cleaning operation in the ball cleaning space 25. In the illustrated embodiment, the bristles are formed of nylon and the container structure is formed of a molded synthetic resin so as to define a low cost, efficient golf ball cleaner device.

The bristles may be supported on the inner surfaces of the device by any suitable means, as desired. In the illustrated embodiment, the parallelepiped container 11 is cubical, having an edge dimension of approximately 3". In the illustrated embodiment, the liquid container portion is filled to a depth of approximately 1" with the cleaning solution.

In use, the player opens the container by disengaging the latch means 36 to swing the cover portion to the open position of FIG. 2 wherein the ball receiving space 25 is exposed for receiving the golf ball 26. Upon closing the cover to the closed position of FIG. 1, the user need merely rotate the carrier 30 by means of handle 33 in a small number of turns, whereby the efficient brushing operation effects a desired cleaning of the ball surface.

Upon opening of the container, the user removes the clean ball from the device, permitting it to be wiped and used as desired. The container is then returned to the closed disposition of FIG. 1, with the latch 36 securing the cover in the closed disposition against spillage of the cleaning solution from the sealingly closed container.

The foregoing disclosure of specific embodiments is illustrative of the broad inventive concepts comprehended by the invention.

I claim:

1. A portable golf ball cleaner comprising:

a container having a bottom wall and sidewalls defining a cleaning liquid receptacle portion and a movable cover portion cooperatively defining an internal, sealed ball cleaning space;

fixed bristles projecting inwardly from at least one of said container portions to define an inner ball receiving space at the inner distal ends thereof;

a carrier rotatably, sealingly mounted to said container to define a portion of a sidewall thereof and having bristles projecting inwardly to said ball receiving space to generally horizontally engage a ball supported therein on said fixed bristles; and means for rotating said carrier portion of the sidewall to cause random rotative movement of a golf ball received in said ball receiving space for cleaning of the ball surface by the distal ends of the bristles, said sealed container portions preventing discharge of cleaning liquid from the container in a closed arrangement thereof.

2. The golf ball cleaner of claim 1 wherein said cover portion is hingedly secured to said liquid receptacle portion.

3. The golf ball cleaner of claim 1 including latch means for releasably locking said cover portion to the liquid receptacle portion in the closed, sealed arrangement of the receptacle.

4. The golf ball cleaner of claim 1 including magnetic latch means for releasably locking said cover portion to the liquid receptacle portion in the closed, sealed arrangement of the receptacle.

5. The golf ball cleaner of claim 1 further including flexible connecting means for attaching the golf ball cleaner to a support such as golf bag.

6. The golf ball cleaner of claim 1 wherein the fixed bristles define an exposed ball receiving space when the cover portion is moved to an open position permitting ready insertion of the ball to be cleaned into the exposed ball receiving space.

7. The golf ball cleaner of claim 1 wherein said bristles on said carrier comprise bristles having a stiffness greater than the stiffness of the fixed bristles.

8. The golf ball cleaner of claim 1 wherein said bristles in said rotating means comprises manually operable handle means.

9. The golf ball cleaner of claim 1 wherein said container comprises a parallelepiped container.

10. The golf ball cleaner of claim 1 wherein said fixed bristles are provided on each of said container portions.

11. A portable golf ball cleaner comprising:

a container having a cleaning liquid receptacle portion and a movable cover portion cooperatively defining an internal, sealed ball cleaning space;

fixed bristles projecting inwardly from said container portions to define an inner ball receiving space at the inner distal ends thereof;

a carrier rotatably, sealingly mounted to said container and having bristles projecting to said ball receiving space to engage a ball supported therein on said fixed bristles, said bristles on said carrier comprising bristles having a stiffness greater than the stiffness of the fixed bristles; and means for rotating said carrier to cause random rotative movement of a golf ball received in said ball receiving space for cleaning of the ball surface by the distal ends of the bristles, said sealed container portions preventing discharge of cleaning liquid from the container in a closed arrangement thereof.

12. The golf ball cleaner of claim 11 wherein said carrier bristles are arranged to generally horizontally engage the golf ball and said fixed bristles are arranged to provide underlying support of the golf ball.

13. A portable golf ball cleaner comprising:

a container having a cleaning liquid receptacle portion and a movable cover portion cooperatively defining an internal, sealed ball cleaning space;

fixed bristles projecting inwardly from said container portions to define an inner ball receiving space at the inner distal ends thereof;

a carrier rotatably, sealingly mounted to said container and having means thereon for effecting random rotation of a golf ball supported in said ball receiving space on said fixed bristles, said means having force transfer characteristics different from those of said fixed bristles; and means for rotating said carrier to cause random rotative movement of a golf ball received in said ball receiving space for cleaning of the ball surface by the distal ends of the fixed bristles, said sealed container portions preventing discharge of cleaning liquid from the container in a closed arrangement thereof.

14. The golf ball cleaner of claim 13 wherein said means for effecting random rotation of the golf ball is arranged to generally horizontally engage the golf ball and said fixed bristles are arranged to provide underlying support of the golf ball.

15. The golf ball cleaner of claim 13 wherein said means for effecting random rotation of the golf ball comprises ball-engaging means on the carrier having a stiffness different from that of the fixed bristles.

* * * * *